US009902535B2

(12) United States Patent
Faragher

(10) Patent No.: US 9,902,535 B2
(45) Date of Patent: Feb. 27, 2018

(54) CHILD-RESISTANT CLOSURE

(71) Applicant: Obrist Closures Switzerland GmbH, Reinach (CH)

(72) Inventor: Stephen Faragher, Norwich Norfolk (GB)

(73) Assignee: Obrist Closures Switzerland GmbH, Reinach (CH)

( * ) Notice: Subject to any disclaimer, the term of this patent is extended or adjusted under 35 U.S.C. 154(b) by 5 days.

(21) Appl. No.: 15/031,245

(22) PCT Filed: Sep. 5, 2014

(86) PCT No.: PCT/EP2014/069008
§ 371 (c)(1),
(2) Date: Apr. 21, 2016

(87) PCT Pub. No.: WO2015/062771
PCT Pub. Date: May 7, 2015

(65) Prior Publication Data

US 2016/0251127 A1 Sep. 1, 2016

(30) Foreign Application Priority Data

Oct. 30, 2013 (GB) ..... 1319118.4

(51) Int. Cl.
*B65D 55/02* (2006.01)
*B65D 50/04* (2006.01)

(52) U.S. Cl.
CPC ..... *B65D 50/041* (2013.01)

(58) Field of Classification Search
CPC .... B65D 50/041; B65D 50/046; B65D 50/02; B65D 50/04; B65D 50/043; B65D 50/045; B65D 50/048
(Continued)

(56) References Cited

U.S. PATENT DOCUMENTS 3,830,390 A 8/1974 Gach
3,857,505 A 12/1974 Mumford et al.
(Continued)

FOREIGN PATENT DOCUMENTS

GB 1438885 A 6/1976
GB 2142612 A 1/1985
WO 2009038318 A2 3/2006

OTHER PUBLICATIONS

Intellectual Property Office of Great Britain, Search Report Issued in Application No. GB1319118.4, dated Feb. 27, 2014, South Wales, 4 pages.

(Continued)

*Primary Examiner* — Kareen Thomas
(74) *Attorney, Agent, or Firm* — McCoy Russell LLP

(57) ABSTRACT

A child-resistant closure for a container, the closure comprising outer and inner nested caps each having a top panel and a side skirt depending generally peripherally therefrom, said outer cap loosely generally encompassing said inner cap to allow relative rotary and axial movement there between, the outer and inner caps having corresponding drive formations which can be brought into driving engagement when the caps are moved axially towards one another to a first axial position, one of the inner and outer caps comprising one or more spring members for urging the inner and outer caps axially away from each other to a second axial position, the other of the inner and outer caps comprising one or more ramps.

9 Claims, 10 Drawing Sheets
(7 of 10 Drawing Sheet(s) Filed in Color)

(58) Field of Classification Search
USPC ..... 215/341, 230, 217–221, 204; 220/255, 220/256, 258, 266, 256.1
See application file for complete search history.

(56) References Cited

U.S. PATENT DOCUMENTS

| | | | | |
|---|---|---|---|---|
| 4,394,916 | A | 7/1983 | Smalley | |
| 5,588,545 | A | 12/1996 | King | |
| 6,085,920 | A | 7/2000 | Moretti | |
| 6,206,216 | B1 | 3/2001 | Stalions | |
| 8,474,634 | B1 | 7/2013 | Branson et al. | |
| 2004/0195197 | A1* | 10/2004 | Miceli | B65D 50/041 215/219 |
| 2011/0139742 | A1* | 6/2011 | Brozell | B65D 50/041 215/220 |
| 2011/0147334 | A1* | 6/2011 | Mettu | B65D 50/041 215/219 |
| 2012/0138561 | A1* | 6/2012 | Brozell | B65D 50/041 215/220 |

OTHER PUBLICATIONS

Intellectual Property Office of Great Britain, Search Report Issued in Application No. GB1319118.4, dated Sep. 5, 2014, South Wales, 3 pages.
ISA European Patent Office, International Search Report and Written Opinion Issued in Application No. PCT/EP2014/069008, dated Dec. 9, 2014, WIPO, 12 pages.

* cited by examiner

CHILD-RESISTANT CLOSURE

CROSS REFERENCE TO RELATED APPLICATIONS

The present application is a U.S. National Phase of International Patent Application Serial No. PCT/EP2014/069008, entitled "A CHILD-RESISTANT CLOSURE," filed on Sep. 5, 2014, which claims priority to Great Britain Patent Application No. 1319118.4 filed on Oct. 30, 2013, the entire contents of each of which are hereby incorporated by reference for all purposes.

TECHNICAL FIELD

The present invention relates generally to child-resistant closures for containers. More particularly the invention relates to a child-resistant safety closure having an improved application/removal drive mechanism.

BACKGROUND AND SUMMARY

Child resistant safety closures comprising two nested closure members are well known. Typically, outer and inner cap members are provided with cooperating sets of lugs which engage each other when the outer closure is rotated in the direction to remove the closure from a container. A plurality of spring fingers on the inner surface of a top panel of the outer closure member urge the outer closure member away from the inner closure member and prevent engagement of the lugs. The outer surface of the top panel of the inner closure member is formed with ramps which are associated with the outer cap member spring fingers so that when the outer cap member is rotated relative to the inner cap member in a direction to apply the closure to a container the spring fingers engage the ramps to cause the cap members to rotate together. When the outer cap member is rotated in the opposite, or unscrewing, direction the spring fingers ride over the ramps to prevent accidental or unwanted removal of the closure. Only when the closure is rotated in the unscrewing direction and an axial force is simultaneously applied to the outer closure member the cooperating lugs are interengaged to unthread the inner closure member from the container.

The present invention seeks to provide improvements in or relating to such closures.

According to a first aspect of the present invented there is provided a child-resistant closure for a container, the closure comprising outer and inner nested caps each having a top panel and a side skirt depending generally peripherally therefrom, said outer cap loosely generally encompassing said inner cap to allow relative rotary and axial movement there between, the outer and inner caps having corresponding drive formations which can be brought into driving engagement when the caps are moved axially towards one another to a first axial position, one of the inner and outer caps comprising one or more spring members for urging the inner and outer caps axially away from each other to a second axial position, the other of the inner and outer caps comprising one or more ramps, the spring member/s providing a biasing force to maintain said outer and inner caps in the second axial position and drivingly engaging the ramps in the second axial position so as to drive the outer and inner caps together in an screwing direction, but slipping over the ramp/s freely in an unscrewing direction, downward pressure on the outer cap overcoming the spring finger bias to move the caps to the first axial position to allow unscrewing of the closure using the inner and outer cap drive formations, in which the external surface of the inner cap side skirt includes one or more axial ribs for allowing venting when the outer and inner caps are initially assembled together.

In some embodiments the assembly rib is formed integrally with an inner cap drive formation. This can be used, for example, to strengthen the formation and may allow for light-weighting of the member by removing material.

The rib may connect to an edge of the drive formation which, in use, engages drivingly with a drive formation on the outer cap.

The rib may extend along substantially the entire length of the skirt.

Each drive formation on the inner cap may have a respective rib.

According to a second aspect there is provided a child-resistant closure for a container, the closure comprising outer and inner nested caps each having a top panel and a side skirt depending generally peripherally therefrom, said outer cap loosely generally encompassing said inner cap to allow relative rotary and axial movement there between, the outer and inner caps having corresponding drive formations which can be brought into driving engagement when the caps are moved axially towards one another to a first axial position, one of the inner and outer caps comprising one or more spring members for urging the inner and outer caps axially away from each other to a second axial position, the other of the inner and outer caps comprising one or more ramps, the spring member/s providing a biasing force to maintain said outer and inner caps in the second axial position and drivingly engaging the ramps in the second axial position so as to drive the outer and inner caps together in an screwing direction, but slipping over the ramp/s freely in an unscrewing direction, downward pressure on the outer cap overcoming the spring finger bias to move the caps to the first axial position to allow unscrewing of the closure using the inner and outer cap drive formations, in which for the or each ramp a respective detent projection is provided which projects above the plane of the top panel and lies in the path of travel of the spring member, the projection supports the spring member when in driving engagement with the ramp to resist deformation of the spring member as it transmits force to the ramp face, the profile of the projection matches the profile of the region of the spring member in contact therewith.

According to a third aspect there is provided a child-resistant closure for a container, the closure comprising outer and inner nested caps each having a top panel and a side skirt depending generally peripherally therefrom, said outer cap loosely generally encompassing said inner cap to allow relative rotary and axial movement there between, the outer and inner caps having corresponding drive formations which can be brought into driving engagement when the caps are moved axially towards one another to a first axial position, one of the inner and outer caps comprising one or more spring members for urging the inner and outer caps axially away from each other to a second axial position, the other of the inner and outer caps comprising one or more ramps, the spring member/s providing a biasing force to maintain said outer and inner caps in the second axial position and drivingly engaging the ramps in the second axial position so as to drive the outer and inner caps together in an screwing direction, but slipping over the ramp/s freely in an unscrewing direction, downward pressure on the outer cap overcoming the spring finger bias to move the caps to the first axial position to allow unscrewing of the closure using the inner and outer cap drive formations, in which the ramp is profiled to support the spring member substantially continuously as the member passes over it in the unscrewing direction.

The profile of the ramp may change constantly as the ramp height increases.

The present invention also provides an inner cap as described herein.

The present invention also provides an outer cap as described herein.

The present invention also provides a closure as described herein in combination with a container.

Different aspects and/or embodiments of the invention may be used separately or together.

Further particular and preferred aspects of the present invention are set out in the accompanying independent and dependent claims. Features of the dependent claims may be combined with the features of the independent claims as appropriate, and in combination other than those explicitly set out in the claims.

The present invention will now be more particularly described with reference to, and as shown in, the accompanying drawings, in which:

BRIEF DESCRIPTION OF FIGURES

This application contains at least one drawing executed in color. Copies of this patent or patent application publication with color drawing(s) will be provided by the Office upon request and payment of the necessary fee.

DETAILED DESCRIPTION

Figure 1:
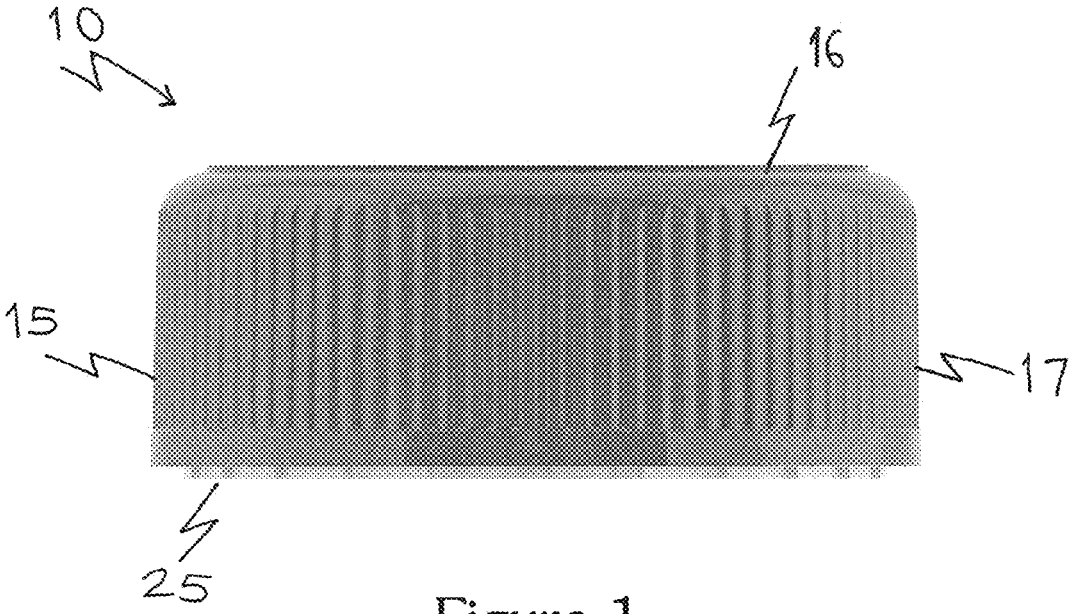
FIG. 1 is a side elevation of a closure formed according to the present invention.
Figure 2:
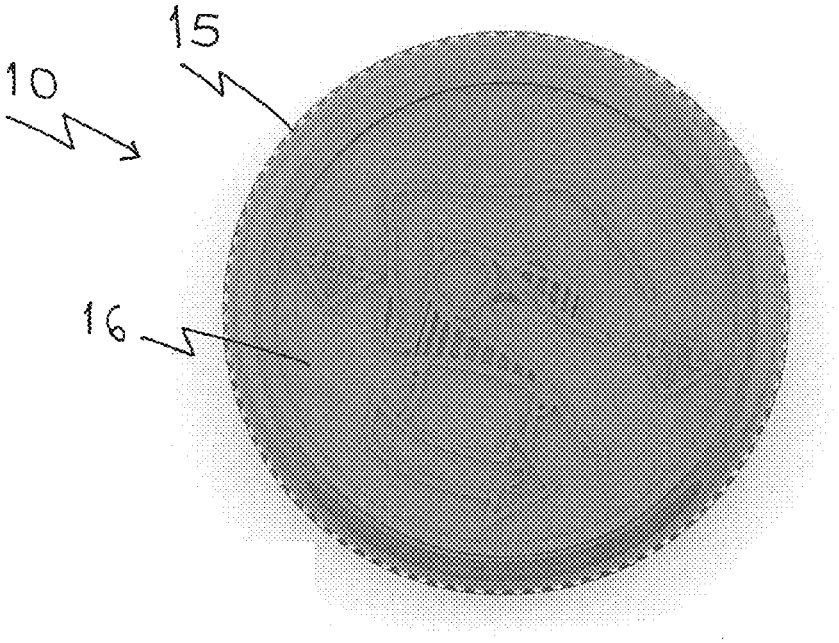
FIG. 2 is a plan view of the closure of FIG. 1.
Figure 3:
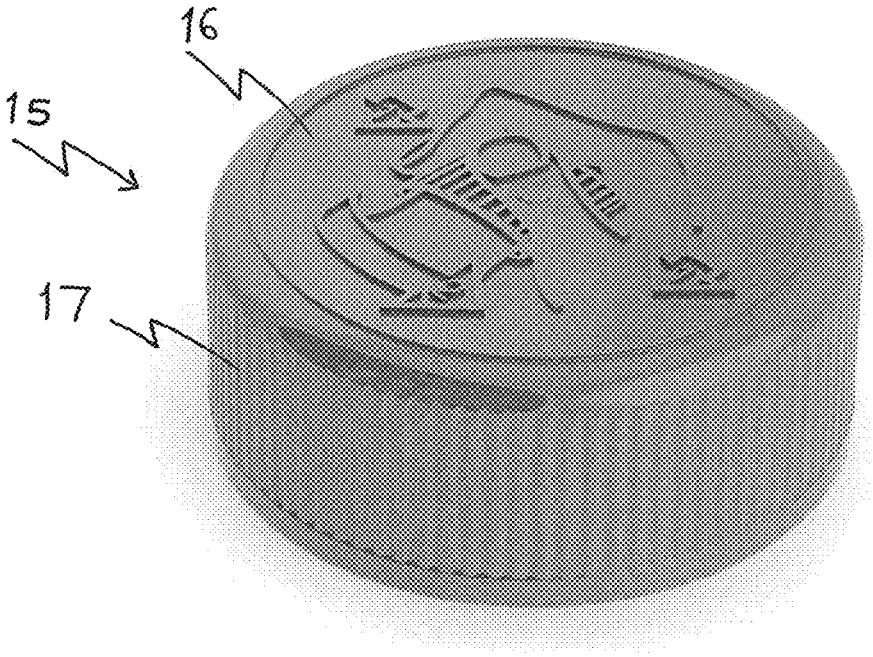
FIG. 3 is a perspective view of the top side of an outer cap forming part of the closure of FIGS. 1 and 2.
Figure 4:
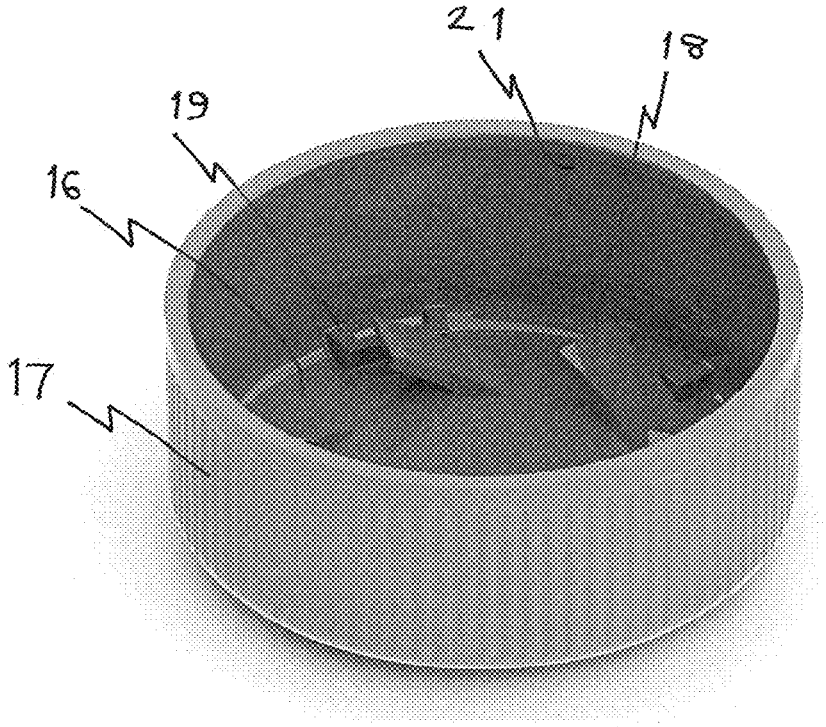
FIG. 4 is a perspective bottom side view of the outer cap of FIG. 3.
Figure 5:
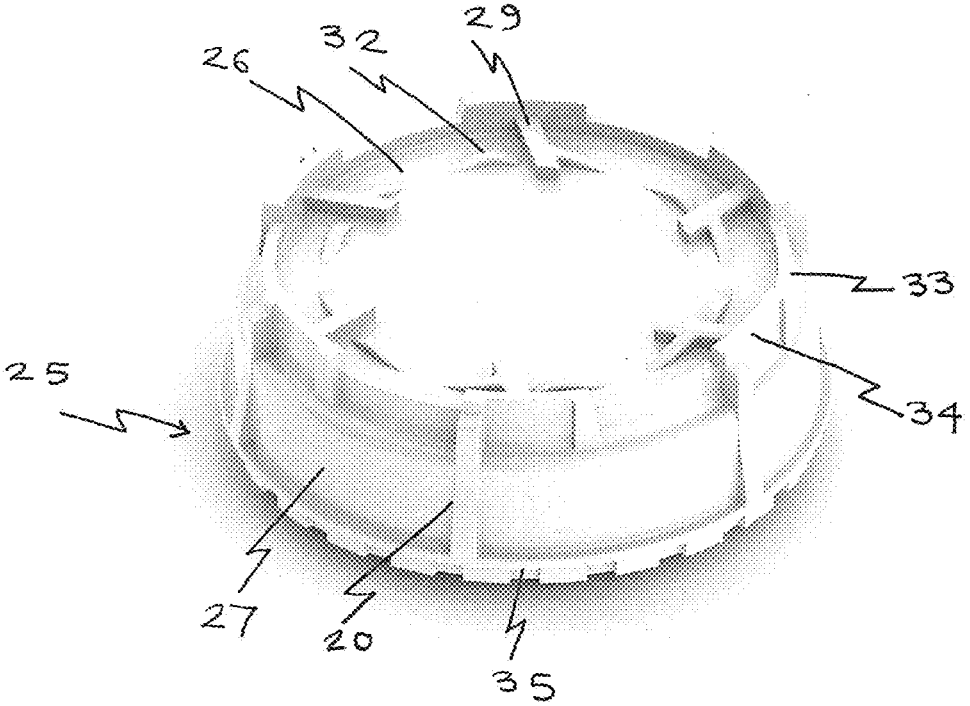
FIG. 5 is a perspective view of the top side of an inner cap forming part of the closure of FIGS. 1 and 2.
Figure 6:
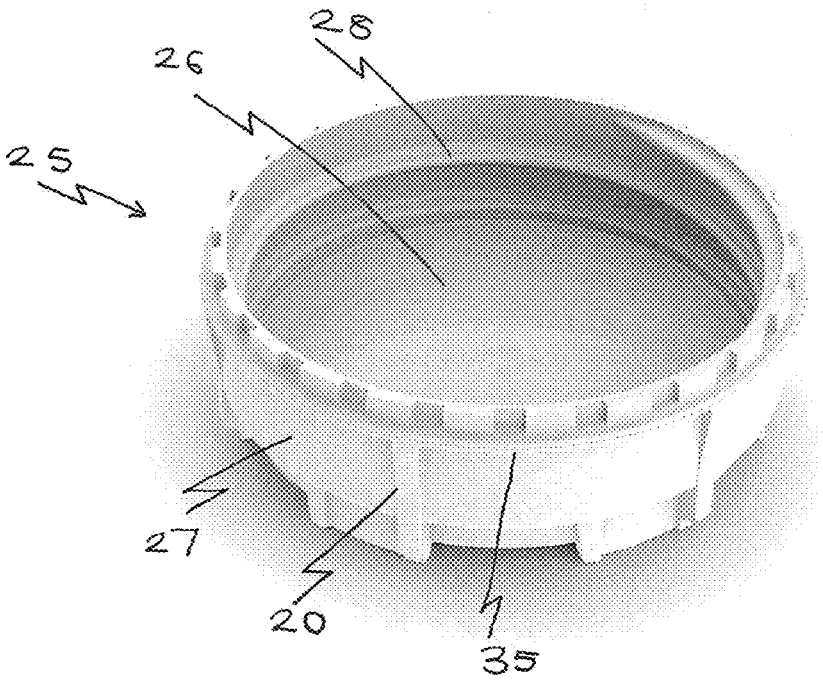
FIG. 6 is a perspective bottom side view of the inner cap of FIG. 5.
Figure 7:
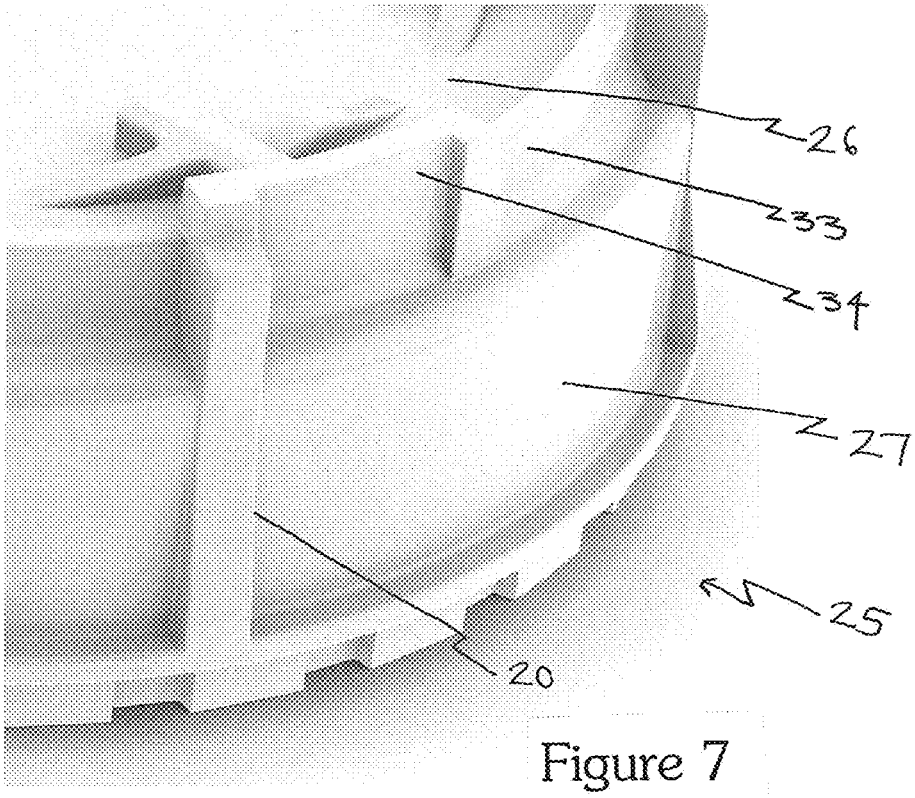
FIG. 7 is a magnified view of the side of the inner cap of FIGS. 5 and 6 illustrating an assembly rib and drive formation.
Figure 8:
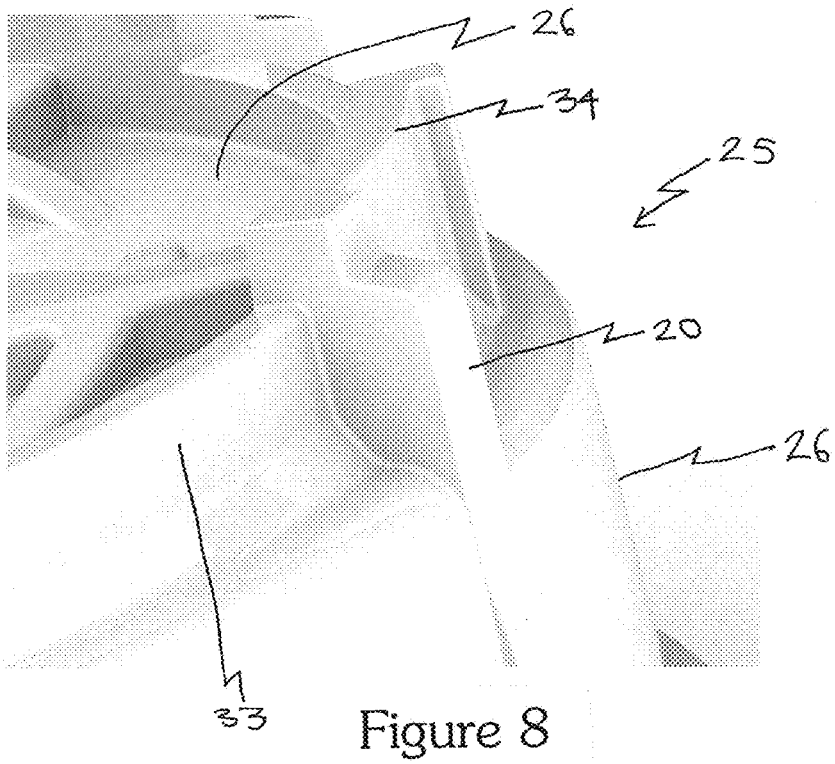
FIG. 8 is a further magnified view of the rib and drive formation of FIG. 7.
Figure 9:
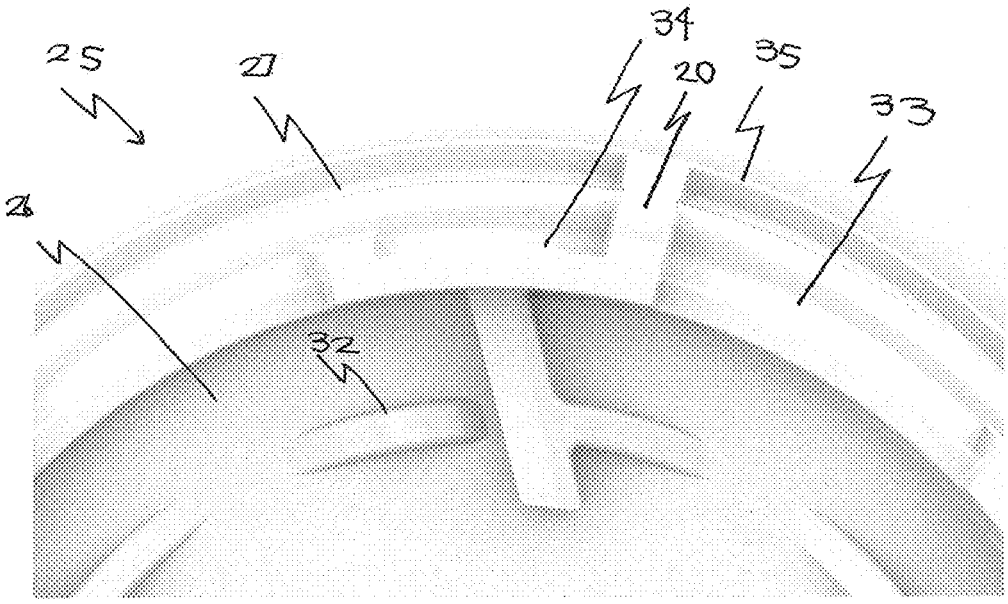
FIG. 9 is a magnified plan view of the inner cap illustrating an improved ramp and detent.
Figure 10:
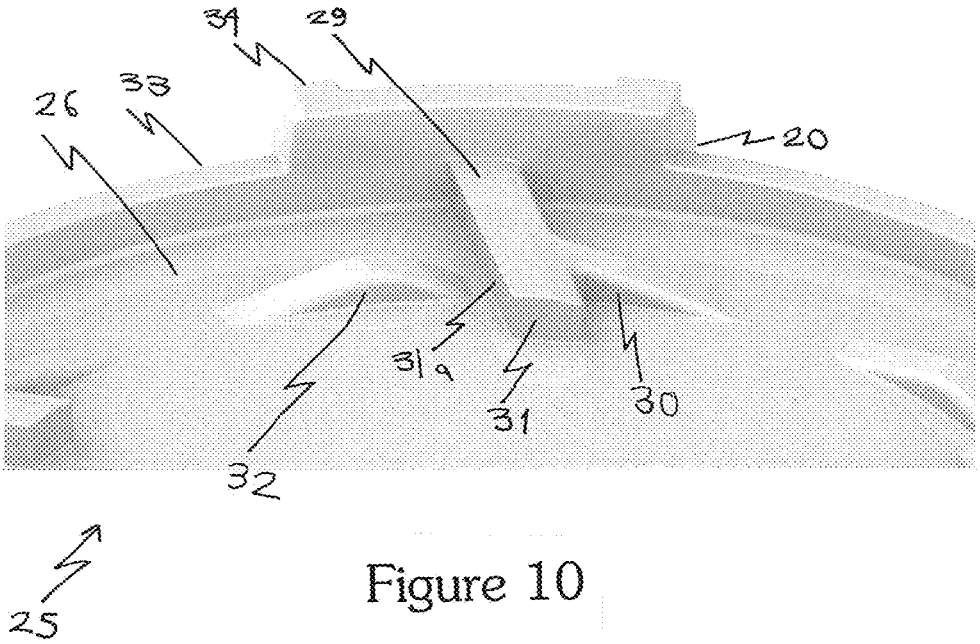
FIG. 10 is a magnified perspective view of the ramp and detent of FIG. 9.

In FIGS. 1 and 2 a closure is shown generally indicated 10. The closure 10 is made up of two components: an outer cap 15, shown in FIGS. 3 and 4 an inner cap 25, shown in FIGS. 5 and 6.

The outer cap 15 is formed with a circular top panel 16 integrally moulded with a depending cylindrical skirt 17. Formed on the underside of the top panel 16 and extending into the interior of the outer cap 15 are a plurality of finger-like spring members 18.

The embodiment illustrated shows six spring members 18, but as few as one or two members may operate satisfactorily, and more than six members may be employed if desired. The spring members 18 take the form of inclined tabs integrally formed with the underside of the top panel 16. The spring members 18 are inclined at an angle of about 45 degrees with respect to the vertical axis of the outer member 10; however, the angle of inclination may be varied as long as a ratcheting function, to be described later, can be properly performed. It will also be noted that the spring members 18 are positioned radially inwards of the periphery of the panel 16. The fingers are curved along their length with generally the same radius of curvature as the sidewall 17.

In addition to the spring members 18, a plurality of drive lugs 19 are also moulded into the underside of the top panel 16 and depend downwardly. The drive lugs 19 are located adjacent to the extreme outer portion of the inside diameter of the outer cap 15 adjacent the depending skirt 17. The drive lugs 19 then extend inwardly toward the springs 18 but their edges terminate before reaching the spring members 18. The illustration of five drive lugs 19 is by way of example and a single drive lug would function properly; but multiple drive lugs are preferred to allow a number of different removal engagement positions.

On the outer surface of the side skirt 26 a plurality of assembly ribs 20 are provided. The ribs 20 extend axially along the skirt and project outwardly therefrom. There are six ribs 20, each one being associated with a respective drive lug 19.

In this embodiment the ribs 20 extend along substantially the full height of the skirt 26. The ribs 20 also extend into and merge with the drive lugs, each connecting to the leading edge (i.e. the edge which is used to provide drive in use) of a respective castellated drive lug.

The ribs 20 allow for the venting of pressure build up as the inner and outer caps are assembled together (see below for further details). In addition, the ribs provide additional strength to support the edge of the drive lug used for engagement when unscrewing the closure. This additional strength allows, in this embodiment, for a thinning of the drive lugs in non-functioning areas. Accordingly the lugs 19 have a very generally shallow U-shape configuration.

A retention bead 21 is moulded into the interior wall of the depending skirt 17 near the open end of the depending skirt 17. The bead 21 is continuous about the entire circumference of the depending skirt 17.

The outer cap 15 may be manufactured of any material sufficiently resilient to provide the necessary spring quality for the integrally moulded spring members 18, for example polyethylene and propylene.

The inner cap 25 is also formed as an integral unit having a circular top panel 26 and a depending skirt 27 attached thereto.

The interior of the depending skirt 27 is provided with a screw thread 28 for engagement with a threaded neck finish of a container.

The upper portion of the inner cap member 25 is of a general configuration that may be considered to be castellated. A ring wall 33 rises above the plane of the top panel 26.

Spaced at intervals around the ring wall 33 are upwardly or axially extending castellation-like drive projections 34. In the assembled closure, the drive lugs 19 on the interior of the outer cap 15 are sized such that they may mesh into the openings between the drive projections 34. This imparts a driving force to the inner cap member 25 so that it may be driven by the outer cap 15.

A retention bead 35 is moulded into the exterior surface of the depending skirt 27. The retention bead 35 extends about the entire circumference of the depending skirt 27 and is of a diameter greater than that of the retention bead 21 formed in the depending skirt 17 of the outer cap 15.

Figure 14:
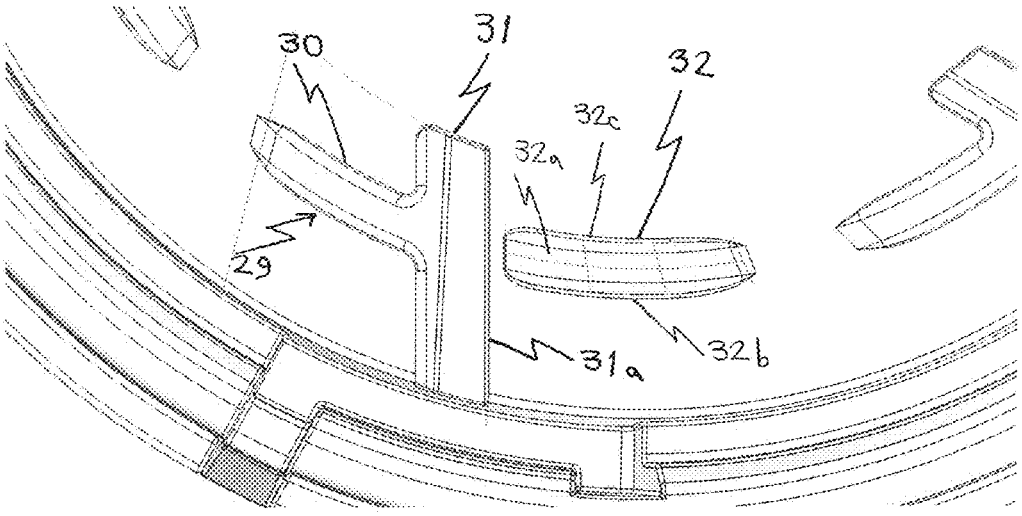
FIG. 14 is a magnified plan view showing the region of a ramp and detent projection of the inner cap.
Figure 15:
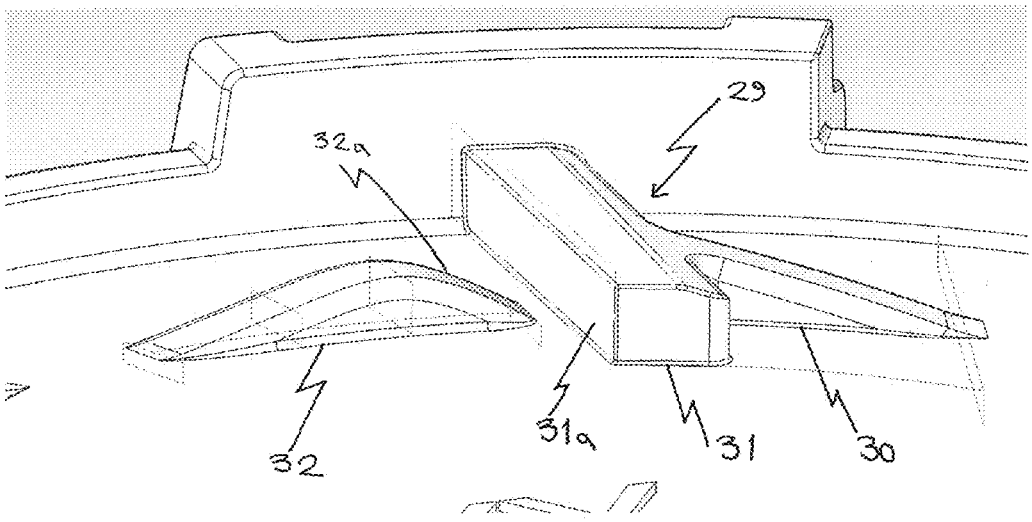
FIG. 15 is a perspective view of the region of FIG. 15.

Referring also to FIGS. 14 and 15, projecting vertically up from and formed integrally with the top panel 26 are a plurality of ratchet lug means. In the embodiment shown the ratchet lug means take the form of six ramp-type lugs 29. Each of the ramp lugs 29 has a substantially L-shaped configuration formed by an inclined ramp portion 30 joined to a radially extending, axially projecting vertical wall portion 31. The beginning of the ramp portion is in a plane substantially identical to the plane of the top panel 26. The vertical wall portion 31 terminates with an abutment face 31*a* and is at an elevation such that the spring members 18 will jam on the face 31*a* if it is attempted to pass them by the vertical wall portion 31. The wall portion 31 extends radially inwards from the ring wall 33, approximately from the middle of the drive projection 34.

The ramp portion 30 is shaped and profiled so as to be sympathetic to the trajectory of the spring fingers as they pass over in use. The portion has a variable section sweep with a section that varies as the ramp height increases i.e. the ramp face is not flat. The trajectory of the portion has a constant radius; the section that sweeps along the radius is constantly changing (in both X and Y planes). This allows the spring finger to be in maximum contact with the ramp through rotation so that there is no time at which there is only a point contact between them. This allows for a ramp to be formed with the minimum amount of material whilst providing maximum contact with the finger during rotation.

Spaced between each of the ramp lugs 29 are hump-like, arcuately extending detent projections 32. The detent projections 32 project above the plane of the top panel 26 and lie in the path of travel of the spring members 18 in use. As discussed further below, the projections 32 hold the spring members 18 in place during application of the closure to transmit the force directly to the ramp face 31*a* and help stop the finger deforming back on itself. The profile of the front section 32*a* of the projections is selected to match the corresponding shape of the part of the spring members which lie over them in use (see FIG. 11) so that the support they provide is maximised. The sides 32*b*, 32*c* of the projections are flat and arcuate and generally match the curvature of the sides of the ramp 30.

The inner cap 25 is an independent closure in itself for a container. The inner 25 therefore may be made of any suitable material and need not necessarily be made of the same material as that of the outer cap 15; a thermoplastic material such as polyethylene or polypropylene may, for example, be used.

The closure 10 is formed by assembling the outer cap 15 and the inner cap 25. To assemble the completed closure, the retention bead 21 is forced over the retention bead 33, in the process causing the depending skirt 17 of the outer closure cap member 10 to spring outwardly slightly. Once the larger diameter retention bead 21 has passed over the retention bead 33, the depending skirt 17 springs back inwardly trapping the inner cap 15 within the outer cap 25. The fit between the outer cap 15 and the inner cap 25 is not tight. There is an appreciable gap between the interior of the depending skirt 16 and the exterior of the depending skirt 32. Thus, the outer cap 15 may both rotate and axially slide with respect to the inner cap 25.

In use the inner cap 25 is threadably engaged on an exteriorly threaded finish of a container. A sealing disk (not shown) may be provided in the inner cap 25 and will be trapped between the upper portion of the finish and the lower portion of the top panel of the inner cap 25.

Figure 11:
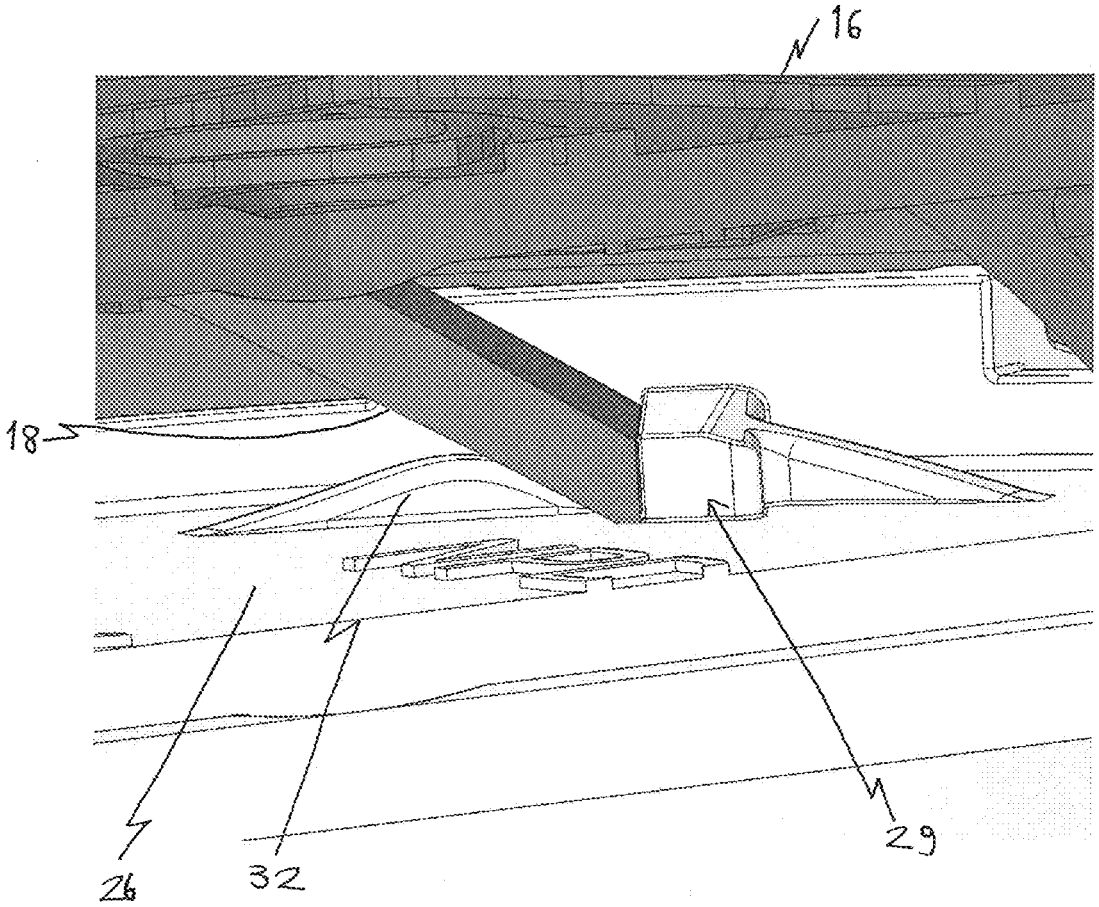
FIG. 11 is a cut-away perspective view illustrating driving engagement of spring fingers on the outer cap with the ramp and detent on the inner cap.

When the outer cap 15 is rotated clockwise the spring members 18 are moved so as to become in driving engagement with respective faces 31*a* as shown in FIG. 11. Thus, the completed closure may be screwed onto the finish of a container, since the rotation of the outer cap 15 will cause the spring members 18 to drivingly engage the ratchet lugs 29 and consequently turn the outer cap 15 and the inner cap 25 as a unit in the tightening direction.

In the tightening direction, the spring members 18 wedge between the ramps 29 and the projections 32.

Figure 12:
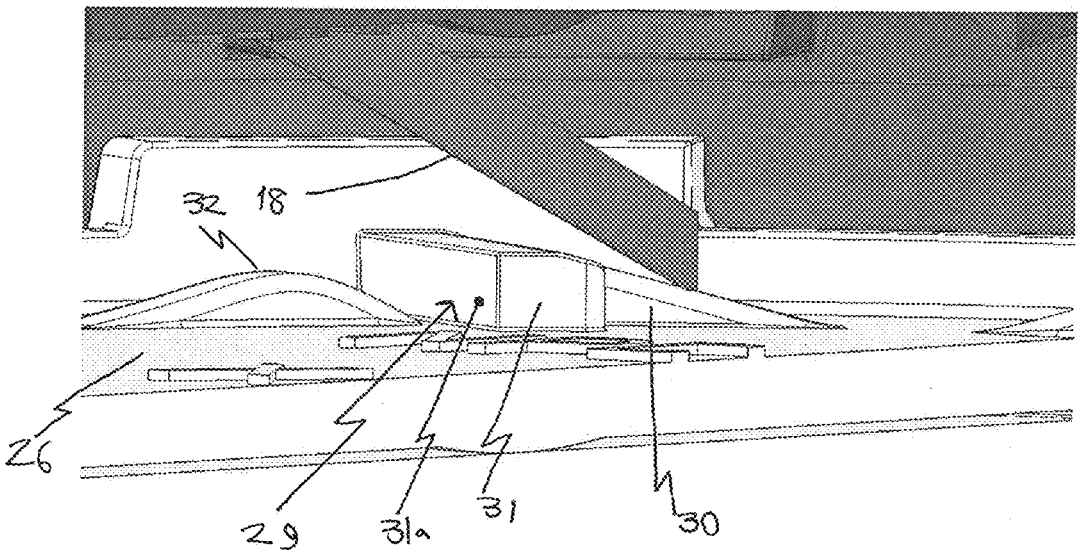
FIG. 12 is a cut-away side perspective view illustrating the fingers of FIG. 11 sliding over the ramp in an unscrewing direction.
Figure 13:
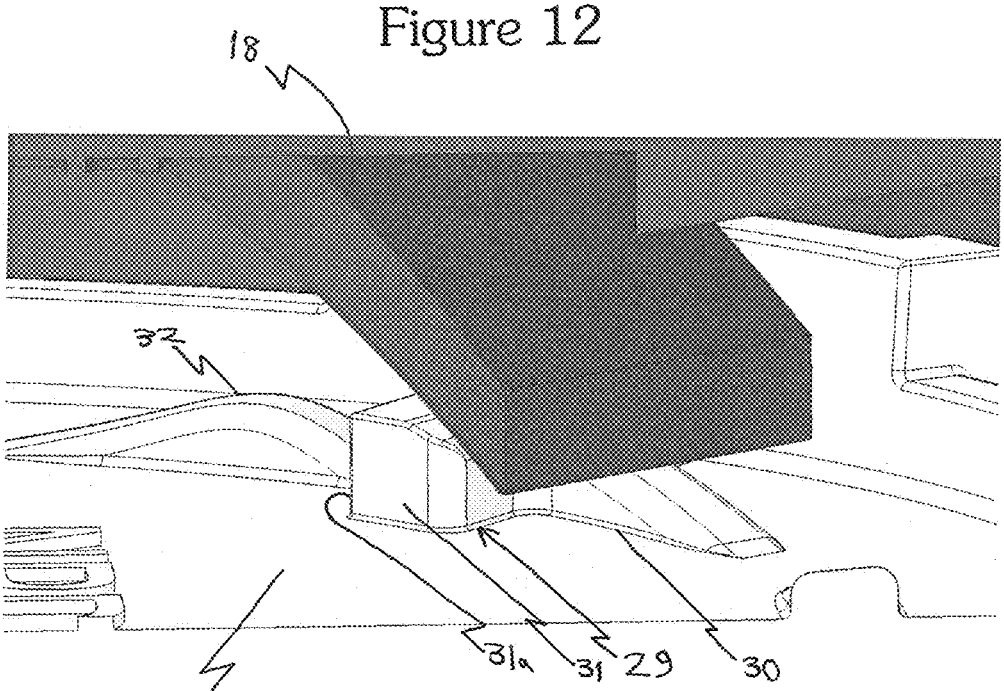
FIG. 13 is a cut-away rear perspective view of the illustration of FIG. 12.

Conversely, as illustrated in FIGS. 12 and 13 it may be seen that if the outer cap 15 is rotated in the opposite direction or the direction normally unscrewing the cap from the container, the springs 18 slip over the ratchet lugs 29. The profile of the ramp 30 changes constantly as the ramp height increases. This allows for maximum support to be provided to the spring fingers 18.

Thus, these two functions provide a one-way ratchet drive for the inner cap 25. The outer cap 15 thus can rotate freely with respect to the inner cap 25 in the unscrewing direction. It is this feature which makes the closure child-resistant, since it is impossible to unscrew the combined closure without an additional motion.

The detent projections 32 act as a further safety feature. If the outer cap 15 is turned in a direction which would normally unscrew the combined closure from the finish, once the springs 18 have risen completely up the ramp portion 30 of the ramp lugs 29 and fallen off the opposite side, the detent projections 32 will tend to hold the springs 18 in that position. It is necessary then to exert further force to move the leaf springs 18 to the next ramp to raise it up the ramp portion 30. In addition, the detent projections 32 are positioned such that the drive lugs 19 are aligned with the drive projections 34 when the springs 18 are stopped by the detent projections 32. This position helps prevent overstressing of the springs 18 when the closure is subjected to a vertical load, as in a warehouse. The drive lugs 19 are in contact with the drive projections 34 to prevent this overstressing.

In this embodiment the ramps 30 and projections 32 are shaped and profiled so that they support the edge/tip of the spring finger during substantially the entire time it is in contact with these features.

To remove the closure from a container finish, the outer cap 15 must be compressed downwardly over the inner cap 25.

The spring members 18 serve to normally keep the outer cap 15 and the inner cap 25 in their axially spaced relationship, in which removal of the closure from the container is impossible. However, utilising the spring function of the springs 18, the outer cap 15 may be pressed downwardly over the inner cap 25. The downward displacement of the outer cap 15 brings the drive lugs 19 into engagement with the spaces between the drive projections 34.

Alignment of the drive lugs 19 and the spaces between the drive projections 34 may not be perfect at the time the outer cap 15 is pressed downwardly. However, slight rotation of the outer cap 15 in the loosening direction will bring these members into proper drive engagement. With the drive lugs 19 properly engaged, the outer cap 15 may be rotated and the inner cap 25 will rotate with it as a unit through this driving engagement.

Once the combined closure is removed from the container and the downward pressure on the outer cap 15 is released, the combined closure will spring back under the influence of the spring member 18, thereby placing the closure in configuration suitable for reapplication. The user may then screw the closure back onto the container finish utilising the driving engagement of the springs 18 and the ratchet lugs 29.

Once back on the container, the combined closure may not be removed again without the downward compression of the outer cap 15 over the inner cap 25. When a child attempts to remove the assembled closure from a container without pressing downwardly on the outer cap 15, an audible warning sound is produced. The springs 18 slipping over the ratchet lugs 29 and hitting the top panel 26 produces a loud and distinctive "clicking" sound. This sound may be heard for some distance and can serve as a warning to parents that children are tampering with a container whose contents may be harmful to them.

The closure of this invention assembled from the outer cap 15 and the inner cap 25 may be applied by conventional capping machinery, since there is no need for any manipulation of the closure during the tightening procedure.

Figure 16:
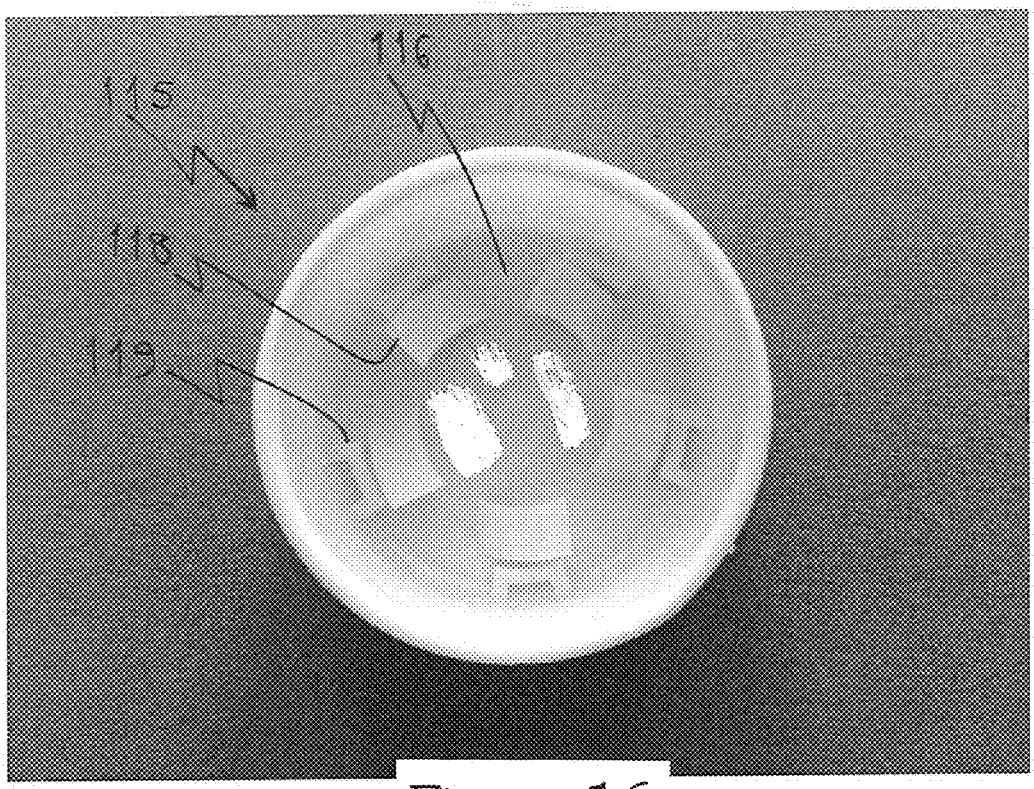
FIG. 16 is an underplan view of an outer cap 115 formed according to an alternative embodiment.

In FIG. 16 the interior of an outer cap 115 formed according to an alternative embodiment is shown. The cap 115 is very similar to the cap 15. The curved spring members 118 and the U-shape drive lugs 119 can clearly be seen.

Figure 17:
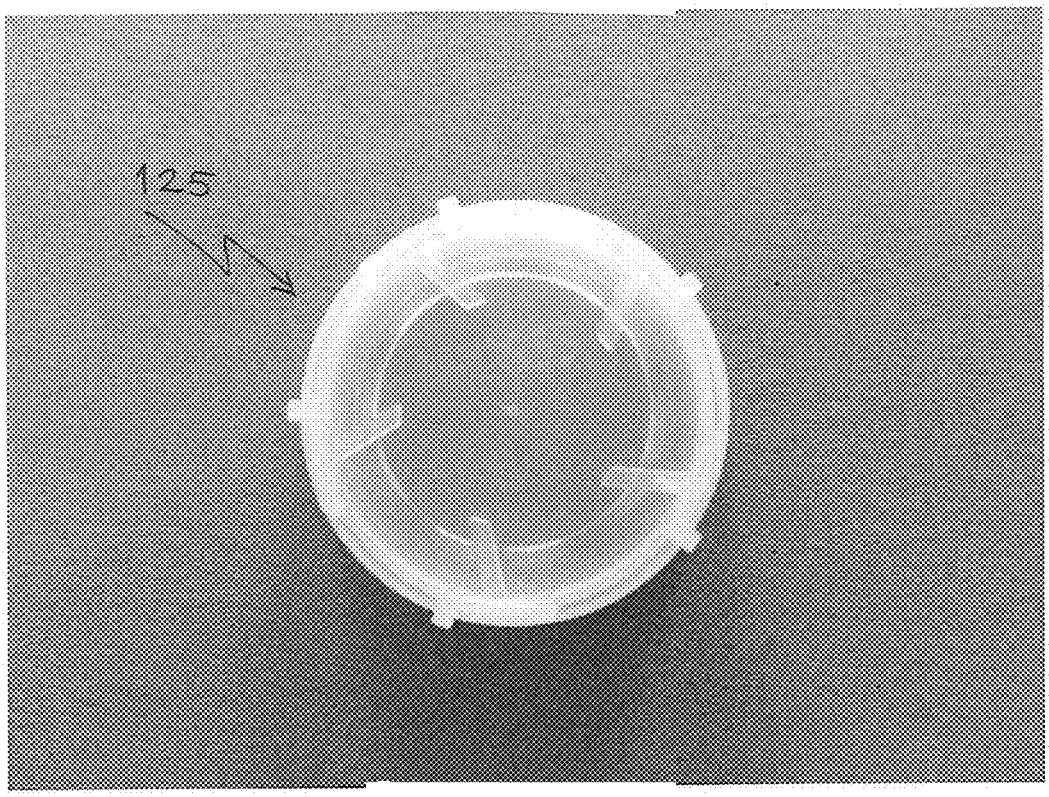
FIG. 17 a plan view of an inner cap for use in conjunction with the outer cap of FIG. 16.

In FIG. 17 a plan view of an inner cap 125 for use in conjunction with the outer cap 115 is shown.

Figure 18:
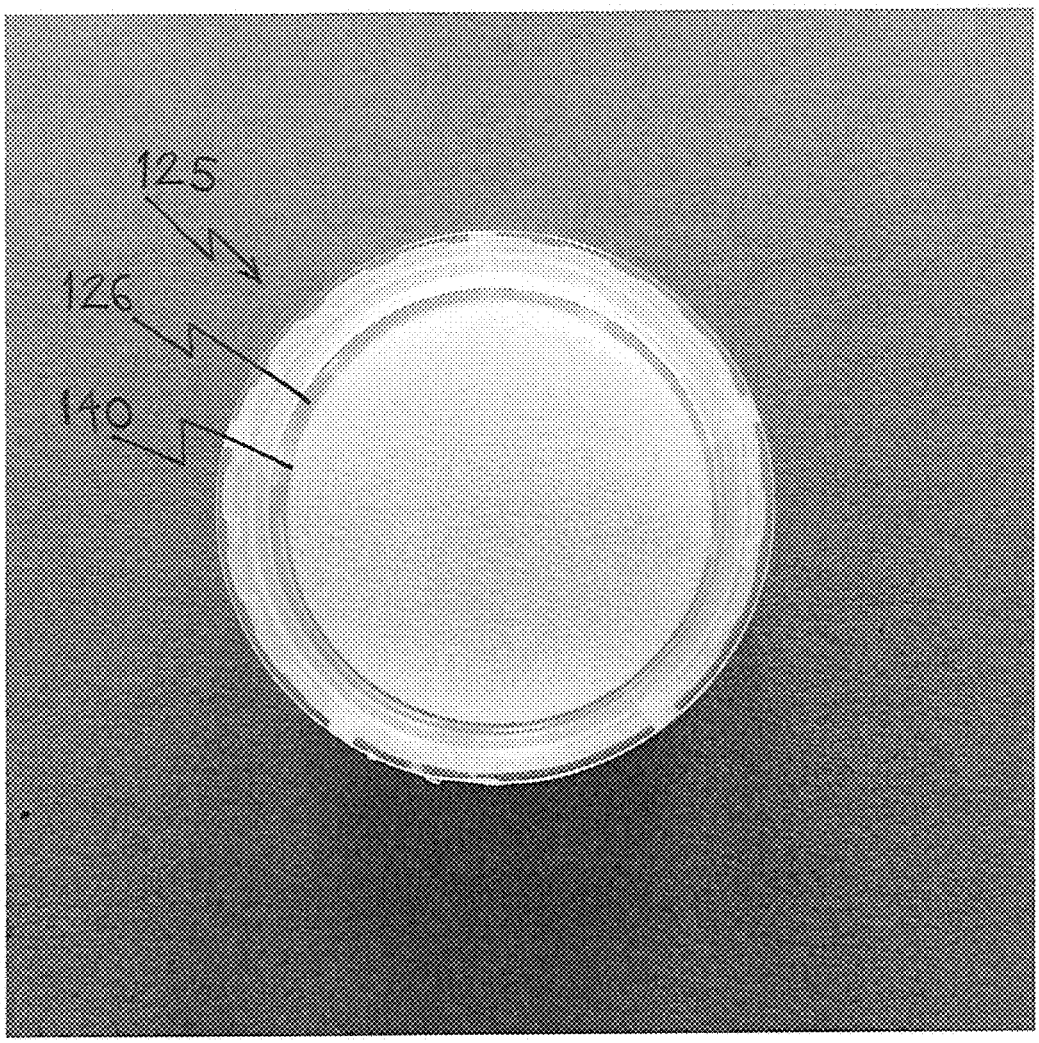
FIG. 18 is an underplan view of the inner cap 125 is shown fitted with a disc-shape seal.

In FIG. 18 an underplan view of the inner cap 125 is shown. The inner cap has been fitted with a disc-shape seal 140 which in this embodiment is attached to the underside of the top panel 126 so that it can seal against the rim of a container neck in use.

Although illustrative embodiments of the invention have been disclosed in detail herein, with reference to the accompanying drawings, it is understood that the invention is not limited to the precise embodiments shown and that various changes and modifications can be effected therein by one skilled in the art without departing from the scope of the invention as defined by the appended claims and their equivalents.

The invention claimed is:

1. A child-resistant closure for a container, the closure comprising outer and inner nested caps each having a top panel and a side skirt depending generally peripherally therefrom, said outer cap loosely generally encompassing said inner cap to allow relative rotary and axial movement there between, the outer and inner caps having corresponding drive formations which can be brought into driving engagement when the caps are moved axially towards one another to a first axial position, one of the inner and outer caps comprising one or more spring members for urging the inner and outer caps axially away from each other to a second axial position, the other of the inner and outer caps comprising one or more ramps, one or more spring members providing a biasing force to maintain said outer and inner caps in the second axial position and drivingly engaging one or more ramps in the second axial position so as to drive the outer and inner caps together in a screwing direction, but slipping over one or more ramps freely in an unscrewing direction, downward pressure on the outer cap overcoming a spring finger bias to move the caps to the first axial position to allow unscrewing of the closure using the inner and outer cap drive formations, in which the ramp is profiled to support the spring member substantially continuously as the member passes over it in the unscrewing direction, in which one or more ramps has a variable section sweep with a generally constant radius trajectory and a section that sweeps along the radius that constantly changes whereby one or more spring members are in maximum contact with one or more ramps through rotation.

2. The closure as claimed in claim 1, in which an external surface of the inner cap side skirt includes one or more axial ribs for allowing venting when the outer and inner caps are initially assembled together.

3. The closure as claimed in claim 2, in which a rib is formed integrally with a drive formation to strengthen the formation.

4. The closure as claimed in claim 3, in which the rib connects to an edge of the drive formation which, in use, engages drivingly with the drive formation on the outer cap.

5. The closure as claimed in claim 2, in which a rib extends along substantially an entire length of the side skirt.

6. The closure as claimed in claim 2, in which the drive formations on the inner cap each have a respective rib.

7. The closure as claimed in claim 1 in combination with a container.

8. A child-resistant closure for a container, the closure comprising outer and inner nested caps each having a top panel and a side skirt depending generally peripherally therefrom, said outer cap loosely generally encompassing said inner cap to allow relative rotary and axial movement there between, the outer and inner caps having corresponding drive formations which can be brought into driving engagement when the caps are moved axially towards one another to a first axial position, one of the inner and outer caps comprising one or more spring members for urging the inner and outer caps axially away from each other to a second axial position, the other of the inner and outer caps comprising one or more ramps, one or more spring members providing a biasing force to maintain said outer and inner caps in the second axial position and drivingly engaging one or more ramps in the second axial position so as to drive the outer and inner caps together in a screwing direction, but slipping over one or more ramps freely in an unscrewing direction, downward pressure on the outer cap overcoming a spring finger bias to move the caps to the first axial position to allow unscrewing of the closure using the inner and outer cap drive formations, in which one or more ramps is profiled to support the spring member substantially continuously as one or more spring members passes over it in the unscrewing direction, in which one or more ramps has a respective detent projection which projects above a plane of the top panel of the inner cap and lies in a path of travel of the spring member, the projection supports the spring member when in driving engagement with the ramp to resist deformation of the spring member as it transmits force to a ramp face, and a profile of the projection matches a profile of the region of one or more spring members in contact therewith.

9. The closure as claimed in claim 8, in which a profile of the ramp changes constantly as a ramp height increases.

* * * * *